US010012380B2

(12) United States Patent
Janvier

(10) Patent No.: US 10,012,380 B2
(45) Date of Patent: Jul. 3, 2018

(54) CONTROL SYSTEM FOR ALLOCATING STEAM FLOW THROUGH ELEMENTS

(75) Inventor: Benoît Janvier, Pointe-Claire (CA)

(73) Assignee: ENERO INVENTIONS INC, Montreal, Quebec ( * ) Notice: Subject to any disclaimer, the term of this patent is extended or adjusted under 35 U.S.C. 154(b) by 479 days.

(21) Appl. No.: 14/398,640

(22) PCT Filed: May 4, 2012

(86) PCT No.: PCT/CA2012/050293
§ 371 (c)(1),
(2), (4) Date: Nov. 3, 2014

(87) PCT Pub. No.: WO2013/163722
PCT Pub. Date: Nov. 7, 2013

(65) Prior Publication Data

US 2015/0107536 A1 Apr. 23, 2015

(51) Int. Cl.
*F22B 35/00* (2006.01)
*F01K 13/02* (2006.01)

(52) U.S. Cl.
CPC ..... *F22B 35/00* (2013.01); *F01K 13/02* (2013.01)

(58) Field of Classification Search
CPC ..... F22B 35/00; F01K 13/00; F01K 13/02
See application file for complete search history.

(56) References Cited

U.S. PATENT DOCUMENTS

| | | | | | |
|---|---|---|---|---|---|
| 4,069,675 | A * | 1/1978 | Adler | B01J 19/0033 | 122/448.1 |
| RE30,589 | E * | 4/1981 | Park | F01K 7/24 | 290/40 B |
| 4,271,473 | A * | 6/1981 | Ross | F01K 7/345 | 290/4 R |
| 4,403,293 | A * | 9/1983 | Bradt | C02F 5/00 | 236/14 |
| 4,421,068 | A * | 12/1983 | Aral | F22B 35/18 | 122/1 R |
| 4,717,468 | A * | 1/1988 | Funk | B01D 3/4255 | 196/132 |
| 4,745,758 | A * | 5/1988 | Putman | F01K 13/02 | 60/664 |
| 5,388,411 | A * | 2/1995 | McKeever | F01K 23/108 | 60/646 |
| 7,028,480 | B2 | 4/2006 | Sekiai | | |
| 2009/0217665 | A1 * | 9/2009 | Holzhauer | F01D 17/00 | 60/645 |

FOREIGN PATENT DOCUMENTS

| | | |
|---|---|---|
| CN | 101680651 | 3/2010 |
| DE | 10 2007 061604 | 6/2009 |
| JP | H01-318802 | 12/1989 |
| JP | H06-257702 | 9/1994 |
| JP | 20012-052785 | 3/2012 |

* cited by examiner

*Primary Examiner* — Nathaniel Herzfeld
(74) *Attorney, Agent, or Firm* — Norton Rose Fulbright Canada LLP

(57) ABSTRACT

There is described herein a method and system for dispatching a single steam flow command to multiple control elements by prioritizing control elements and measuring responsiveness and availability of the control elements using feedbacks. The dispatched single steam flow command may then be adjusted as a function of the responsiveness of each control element.

25 Claims, 15 Drawing Sheets

| | Max Flow (KPPH*) | Ratio |
|---|---|---|
| 241a P1 | 500 | 25% |
| 241b P2 | 300 | 15% |
| 241c P3 | 300 | 15% |
| 241d P4 | 500 | 25% |
| 241e P5 | 400 | 20% |
| **Total** | **2000** | |

*kilopounds per hour

FIGURE 5b

Case 1: All-Automatic (25% Demand)

Demand 25% 500/2000

| | | $S_{out}$ | Flow |
|---|---|---|---|
| 241a | Line 1 | 100% | 500/500 |
| 241b | Line 2 | 0% | 0/300 |
| 241c | Line 3 | 0% | 0/300 |
| 241d | Line 4 | 0% | 0/500 |
| 241e | Line 5 | 0% | 0/400 |
| | | | 500/2000 |

FIGURE 5c

CONTROL SYSTEM FOR ALLOCATING STEAM FLOW THROUGH ELEMENTS

CROSS-REFERENCE TO RELATED APPLICATIONS

This is the first application filed for the present invention.

TECHNICAL FIELD

The present invention relates to the field of control for energy distribution systems.

BACKGROUND OF THE ART

Steam is used as a primary energy source for various industrial plants. The steam is typically generated by boilers and supplied within the steam distribution network to steam headers having different pressures. The headers in turn allocate the steam to the different plant units. As the flow demand for downstream process units often varies, control systems are used to ensure pressure stability in the headers. For this purpose, steam lines provided between the headers are manipulated to control the pressure levels. However, the steam lines follow complex pathways and sub-networks and traditional methods used for pressure control tend to manipulate inlet and outlet flows by focusing on a punctual offset regardless of the origin or destination of the flows. Moreover, known control systems usually rely heavily on pressure reducing valves at the expense of economic optimization. This ultimately decreases the potential revenue of the plant, thus making the on-line process decisions less economically viable.

Therefore, there is a need for an improved pressure control system.

SUMMARY

There is described herein a method and system for dispatching a single steam flow command to multiple control elements by prioritizing control elements and measuring responsiveness and availability of the control elements using feedbacks. The dispatched single steam flow command may then be adjusted as a function of the responsiveness of each control element.

In accordance with a first broad aspect, there is provided a control system for allocating a flow of steam from or to a steam header having a first pressure level to or from a plurality of pressure adjusting devices. The system comprises a pressure unit adapted to measure the first pressure level in the steam header, determine a difference between the first pressure level as measured and a desired pressure level, and generate a demand signal representative of a steam flow demand needed to adjust the pressure level in the steam header to correspond to the desired pressure level; at least one status monitoring unit coupled to the plurality of pressure adjusting devices for monitoring an output flow thereof; and a dispatching device having at least one input coupled to the pressure unit and to the at least one status monitoring unit, and at least one output coupled to the plurality of pressure adjusting devices. The dispatching device is adapted to: receive the demand signal from the pressure unit; allocate the flow of steam among the plurality of pressure adjusting devices from the steam header as a function of the demand signal and in accordance with a priority scheme; receive from the status monitoring unit at least one feedback signal representative of the output flow of the plurality of pressure adjusting devices; and adjust allocation of the flow of steam on the basis of the at least one feedback signal.

Still in accordance with another broad aspect, there is also provided a method for allocating a flow of steam from or to a steam header having a first pressure level to or from a plurality of pressure adjusting devices. The method comprises measuring the first pressure level in the steam header; determining a difference between the first pressure level as measured and a desired pressure level; generating a demand signal representative of a steam flow demand needed to adjust the pressure level in the steam header to correspond to the desired pressure level; allocating the flow of steam among the plurality of pressure adjusting devices from the steam header as a function of the demand signal and in accordance with a priority scheme; monitoring an output flow of the plurality of pressure adjusting devices; and adjusting allocation of the flow of steam on the basis of the output flow as monitored.

In the present specification, the term "threshold" should be understood to mean any set value or parameter used for comparison to a measured value either in a continuous manner or in a discrete (periodic or not) manner.

BRIEF DESCRIPTION OF THE DRAWINGS

Further features and advantages of the present invention will become apparent from the following detailed description, taken in combination with the appended drawings, in which:

FIG. 5*b* is a table of available flow lines of a steam distribution network using smart splitters in accordance with an illustrative embodiment of the present invention;

FIG. 5*c* is a table of an apportionment of a 25% steam flow demand when output lines are in automatic mode in accordance with an illustrative embodiment of the present invention;

It will be noted that throughout the appended drawings, like features are identified by like reference numerals.

DETAILED DESCRIPTION

Figure 1:
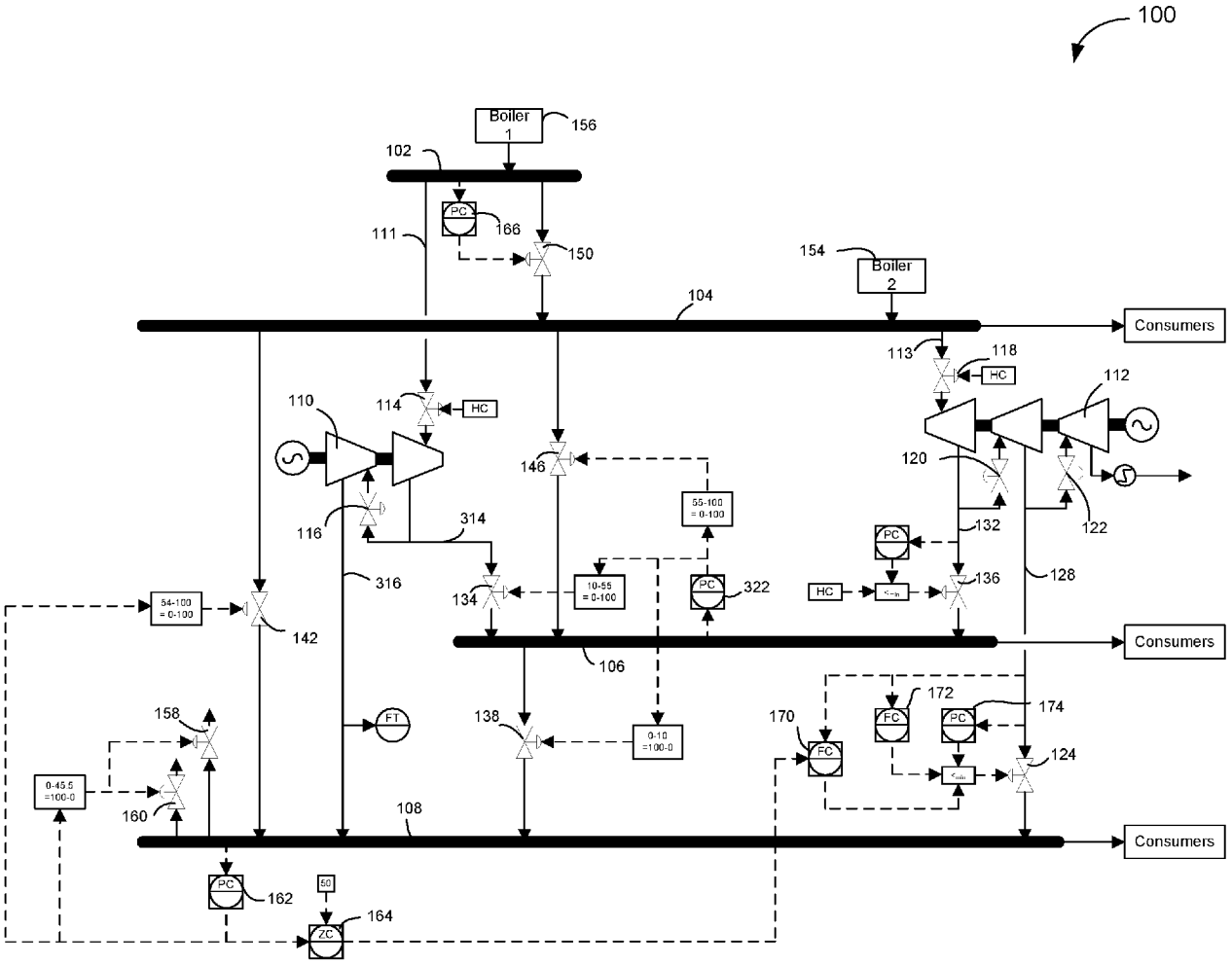
FIGURE 1 (PRIOR ART)
FIG. 1 is a schematic diagram of a prior art steam distribution network.

Referring to FIG. 1, a prior art steam distribution network 100 used to convey steam generated in two boilers to the point where the steam's heat energy is required will now be described. The network 100 illustratively comprises four steam headers 102, 104, 106, and 108, which are the main steam supply headers of two boilers 154 and 156 which generate thermal energy in the form of steam. Each header 102, 104, 106, and 108 collects from the boiler pressurized steam, which is supplied at different pressure levels, and moves the collected steam through the network 100. Steam having a gauge pressure of 1600 psig illustratively flows through the 1600 psig steam header 102, steam having a gauge pressure of 1000 psig flows through the 1000 psig steam header 104, steam having a gauge pressure of 230 psig flows through the 230 psig steam header 106, and steam having a gauge pressure of 70 psig flows through the 70 psig steam header 108. In the boiling drums (not shown) of the two boilers 154 and 156, steam is separated from the liquid water, such that the latter becomes as dry as possible. Steam should indeed be available at the point of use, dry, clean, free from air and incondensable gases, and in the appropriate quantity, temperature, and pressure for each application. The steam is then delivered to areas of the steam distribution system 100 where the steam is needed for electrical power generation, mechanical drives or industrial processes.

For this purpose, the network 100 illustratively comprises steam turbines 110 and 112 for extracting thermal energy from the pressurized steam supplied thereto and generating electrical power for delivery to processes throughout the plant or distribution to the local electricity grid for additional income. The steam turbines 110 and 112 further provide a means of stepping down steam pressure while extracting mechanical work. A steam line 111 from the 1600 psig steam header 104 illustratively supplies the steam turbine 110 through a valve 114. Similarly, a steam line 113 from the 1000 psig header 104 supplies the steam turbine 112 through a valve 118. Turbine valves 116, 120 and 122 may further be used to distribute the flow of steam between the different extractions and the latter stage of the turbines 110 and 112. The steam turbines 110 and 112 may operate in parallel with their respective exhausts 316 and extraction 128 supplying the 70 psig steam header 108. The respective extractions 314 and 132 of the steam turbines 110 and 112 may further supply the 230 psig steam header 106 respectively through pressure reducing control valves 134 and 136.

Steam may be supplied from the 230 psig steam header 106 to the 70 psig steam header 108 through a pressure control valve 138. Steam may similarly be supplied from the 1000 psig steam header 104 to the 70 psig steam header 108 through a pressure reducing valve 142 to reduce the 1000 psig steam pressure level to 70 psig and to the 230 psig steam header 106 through a pressure control valve 146 to reduce the 1000 psig steam pressure level to 230 psig. Steam is also illustratively supplied from the 1600 psig steam header 102 to the 1000 psig steam header 104 through a pressure control valve 150 to reduce the 1600 psig steam pressure level to 1000 psig. The 1000 psig steam header 104 may further be supplied by the boiler 154. The boiler 156 may further be provided for supplying the 1600 psig steam header 102. The network 100 may comprise vent valves 158 and 160, which are adapted to open in order to release steam into the atmosphere from the 70 psig steam header 108

A plurality of individual pressure controllers 162 further monitor and maintain the pressure level of a steam header, such as the 70 psig steam header 108. They may be coupled to by independently adjusting feed flows to the corresponding steam header. For instance, if the pressure controller 162 determines that the pressure level of the 70 psig steam header 108 is above 70 psig, the output signal of the pressure controller 162 may be reduced to decrease the flow to the 70 psig header 108. Illustratively, the 70 psig pressure controller 162 is operating with an output of 50%, which is maintained by a position controller 164 by increasing or reducing the turbine 112 second extraction flow demand to a flow controller 170. The output of the flow controller 170 to the extraction control valve 124 controlling extraction from the turbine 112 may be limited by a flow controller 172, which economically optimizes the use of the extraction 128 of the turbine 112, and a pressure controller 174, which protects the turbine if the pressure of the extraction 128 decreases beyond mechanically acceptable limits. Both controllers 172 and 174 illustratively limit the ability of the position controller 164 to keep the 70 psig pressure controller 162 output to 50%. In these cases, the 70 psig pressure controller 62 may change its output, either to open the 1000 psig to 70 psig pressure reduction valve 142 or to open the vent valves 158 and 160. The output of the 170 psig pressure controller 162 may then be changed from 50% to either a higher rate, e.g. 54%, to start to open the pressure reduction valve 142 or to a lower rate, e.g. 45.5%, to open the vent valves 158 and 160.

The network 100 may comprise a pressure controller 166 for controlling the pressure level of the 1600 psig steam header 102 and maintaining a constant outlet pressure from the boiler 156. The network 100 may also comprise a pressure controller 322 for controlling the pressure level of the 230 psig steam header 106. In order to increase steam flow to the header 106, the output signal of the controller 322 may be changed to close the pressure reduction valve 138, open the extraction control valve 134, and/or open the pressure reduction valve 146. The inlet flow of the turbine 112 may be manipulated by the operator by changing the position of the inlet valve 113 and the first extraction flow may be manipulated by an operator by changing the position of the extraction valve 136 to economically optimize turbine usage according to the current combustible and electricity price. Similarly, the inlet flow of the turbine 110 may be manipulated by the operator by changing the position of the inlet valve 114 to economically optimize turbine usage according to the current combustible and electricity price.

Figure 2:
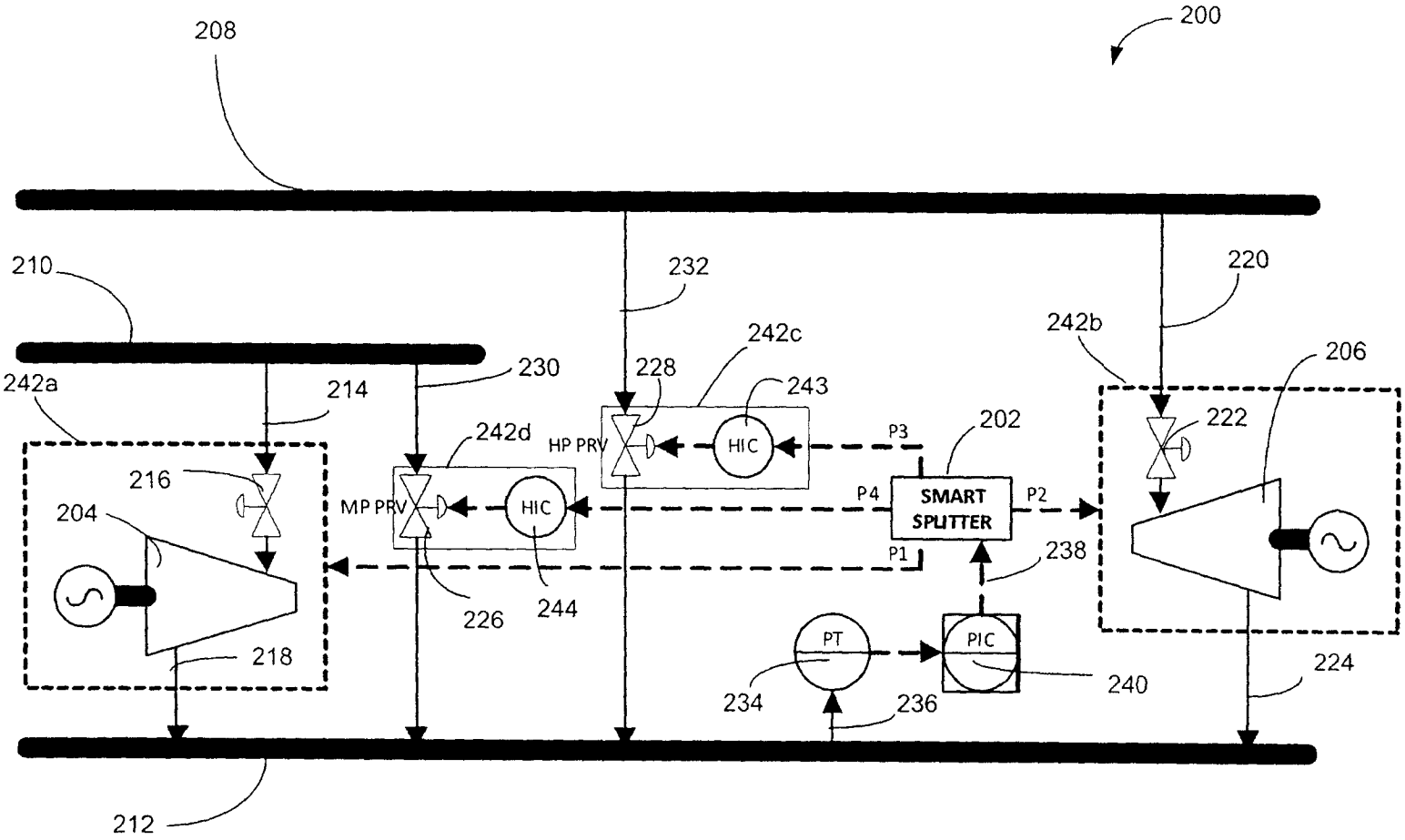
FIG. 2 is a schematic diagram of a steam distribution network using a four-lines smart splitter in accordance with an illustrative embodiment of the present invention.

Referring now to FIG. 2, a control system 200 using a smart splitter 202 will now be described. The smart splitter 202 is adapted to dispatch a single steam flow demand from a pressure controller 240 to different components of the system 200 for optimizing power generation, controller robustness, and flexibility of operation, as will be described further below. The system 200 illustratively comprises a first steam turbine 204 and a second steam turbine 206 as well as a high pressure header 208, a medium pressure header 210, and a low pressure header 212. The steam turbine 204 illustratively extracts steam from the medium pressure header 210 through a steam line 214 connected to a control valve 216. The exhaust 218 of the steam turbine 204 then supplies the low pressure steam header 212. The steam turbine 206 also illustratively extracts steam from the high pressure header 208 through a steam line 220 connected to a control valve 222 and has an exhaust 224, which supplies the low pressure steam header 212. Steam from the medium pressure header 210 may further be sent through a steam line 230 to a medium pressure reducing valve 226 for entering the low pressure steam header 212 at a reduced pressure. Steam from the high pressure header 208 may also be sent through a steam line 232 to a high pressure reducing valve 228 for entering the low pressure steam header 212.

The smart-splitter 202 is illustratively set to maximize electricity generation by distributing flow, in the following order: turbine 204, turbine 206, pressure reduction valve 228, and pressure reduction valve 226. In the event of a limited availability of a higher priority actuator, the flow distribution may be automatically be moved to the lower priority actuator to keep the steam flow to the header steady. For example, if the flow to the turbine 204 is maximized and the turbine 204 suddenly trips, the smart splitter 202 may automatically redistribute steam flow to the lower priority elements, i.e. the turbine 206, and the pressure reduction valves 226 and 228, to fulfill the loss of flow through the turbine 204.

Figure 3:
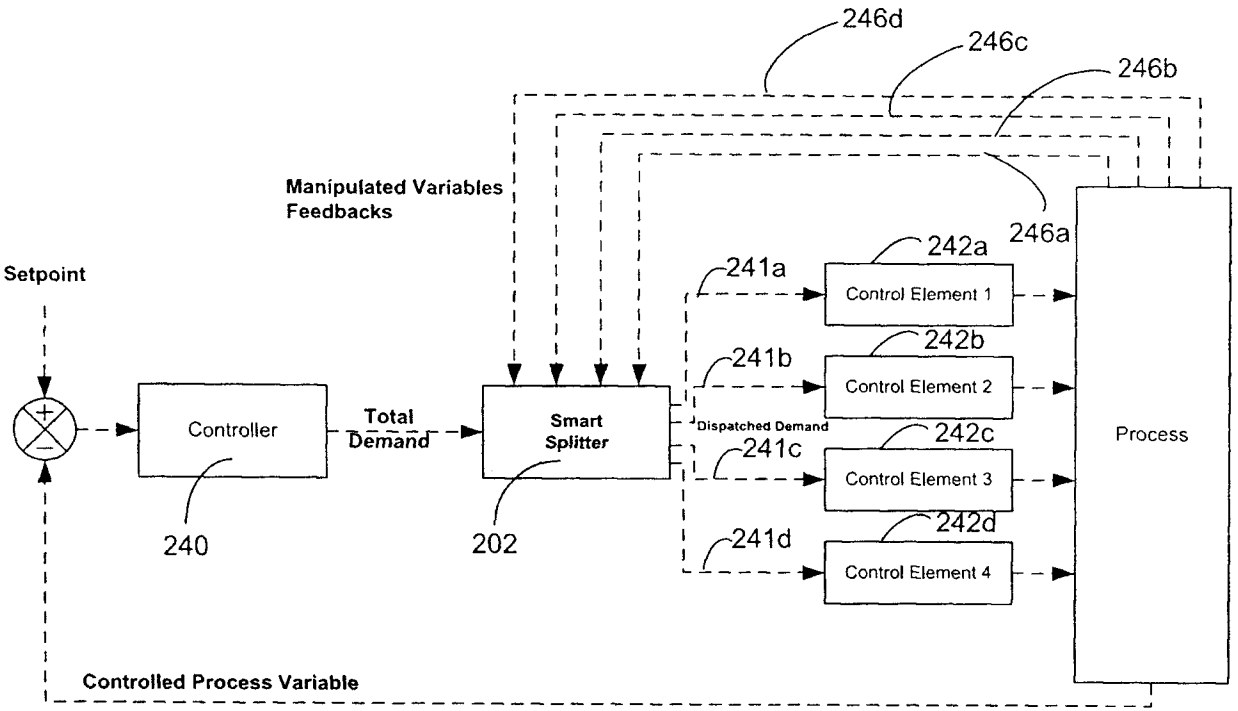
FIG. 3 is a schematic diagram of a control loop using the smart splitter of FIG. 2.

Referring to FIG. 3 in addition to FIG. 2, in order to control the pressure level of the steam flowing through the system 200, a pressure transmitter 234 may monitor via a steam line 236 a pressure level of the low pressure steam header 212. The pressure transmitter 234 then communicates with a pressure controller 240, which determines from the measured pressure level and the set point pressure level a steam flow demand, i.e. the amount of pressure that should be supplied to (or alternatively removed from) the low pressure steam header 212 in order to adjust the pressure thereof. The pressure controller 240 then sends an electrical signal 238 comprising the steam flow demand to the smart splitter 202. It should be understood that the pressure transmitter 234 and the pressure controller 240 may together form a single pressure unit in communication with the smart splitter 202. Also, the control system 200 may be set such that the pressure controller 240 further compares the pressure level to a threshold to determine whether the pressure level is too high or too low and should be adjusted.

The smart splitter 202 illustratively has a plurality of outputs and a 0-100% input range, which represents the total steam flow capability of the outputs. Upon receiving the electrical signal 238 and accordingly interpreting the latter to retrieve the steam flow demand, the smart splitter 202 illustratively applies internal logic to generate signals (241*a*, 241*b*, 241*c* and 241*d*) indicative of how the total steam flow demand should be divided among a plurality of control elements as in 242*a*, 242*b*, 242*c*, and 242*d* coupled to the outputs of the smart splitter 202. The internal logic applied by the smart splitter 202 is illustratively based on process considerations and follows a pre-determined priority scheme based on economic factors, which indicates which control elements as in 242*a*, 242*b*, 242*c*, and 242*d* should receive which portion (from 0 to 100%) of the total flow demand. Upon receiving the signal from the smart splitter 240, each control element 242*a*, 242*b*, 242*c*, or 242*d* takes action to accordingly increase or decrease its steam flow, thus adjusting the pressure level in the low pressure header 212. Each control element 242*a*, 242*b*, 242*c*, or 242*d* may be the combination of a hand controller as in 243 or 244 and a pressure reducing valve as in 226 or 228 or the combination of a turbine as in 204 or 206 and a control valve 216 or 222 depending on the existing instrumentation and control scheme.

Each output of the smart splitter 202 may indeed be connected to a hand controller 243 or 244, which is used to interface the smart splitter 202 with multiple valves as in 226 and 228. The hand controllers 243 and 244 provide flexibility to the operator who may shift the valves 228 and 226 respectively coupled to the hand controllers 243 and 244 into a manual mode. In such a manual mode, the position of the valves 226 and 228, and accordingly the amount of steam flowing therethrough, may be controlled manually by the operator rather than via the smart splitter 202 when the hand controllers 243 and 244 are in a cascade mode. In cascade mode, the value which is input to a hand controller 243 or 244 may be output to the corresponding valve 228 or 266 with a predefined maximum ramp rate for limiting the output ramp rate of the hand controller 243 or 244. Minimum and maximum limits may also be defined to limit the output range of the hand controller 243 or 244. In manual mode however, the operator may be provided full manual access to the output value of the hand controllers 243 and 244. This proves useful in making manual changes to the process control, which permits equipment testing, troubleshooting and maintenance. An intermediate or balance mode may further be provided for smoothly transitioning from the manual mode to the cascade mode. When the hand controller 43 or 244 is not in cascade mode, its control element 242*c* or 242*d* is considered as not available by the smart splitter 202 and the demand is apportioned to the remaining control elements 242*a*, 242*b* taking the quantity of steam flowing through the non-available control element 242*c* or 242*d* into account.

A feedback mechanism is illustratively provided so that the smart splitter 202 may track the state of each control element 242*a*, 242*b*, 242*c*, or 242*d* and adapt the steam flow dispatch accordingly. The smart splitter 202 may therefore determine the appropriate apportionment of the steam flow demand in case of a discrepancy between the demand and the responsiveness of the control elements 242*a*, 242*b*, 242*c* and 242*d*. For this purpose, feedback signals as in 246*a*, 246*b*, 246*c* and 246*d* representative of the state of each control element 242*a*, 242*b*, 242*c* and 242*d* may be sent to the smart splitter 202 to monitor the individual responses of the control elements 242*a*, 242*b*, 242*c* and 242*d*. The feedback signals 246*a*, 246*b*, 246*c* and 246*d* illustratively result from a calculation based on process parameters rather than directly from flow transmitters (not shown), thus mitigating losses of communication and circumventing readings noise. For example, the position of the pressure reduction valve 226 or 228 may be used to recalculate the flow based on its flow characteristic instead of the flow transmitters. Alternatively, the feedback signals 246*a*, 246*b*, 246*c* and 246*d* may result from a calculation based on turbine state or on valve position.

The feedback signals 246*a*, 246*b*, 246*c* and 246*d* received at the smart splitter 202 allow the latter to take into account the state of the control elements 242*a*, 242*b*, 242*c* and 242*d* in dispatching the total steam flow demand. Part of the demand may indeed be transmitted to lower-priority lines coupled to the lower-priority control elements as in 242*b* and 242*c* to palliate a slow response of the higher-priority control element 242*a* or a lack of flow availability in the higher-priority line coupled thereto. For instance, if the smart splitter 202 sends a dispatch signal to the highest priority control element 242*a* but no response is measurable in the process, for instance due to a trip of the turbine 204, an appropriate feedback signal 246*a* may be sent to the smart splitter 202 to this effect. Upon receiving the feedback signal 246*a*, the smart splitter 202 may automatically adjust the dispatch by increasing the steam flow demand directed to the control elements having lower priority, namely control elements 242*b* and 242*c*, in order to keep the total flow to the header 212 equivalent to the flow demand from the pressure controller 240.

Figure 4:
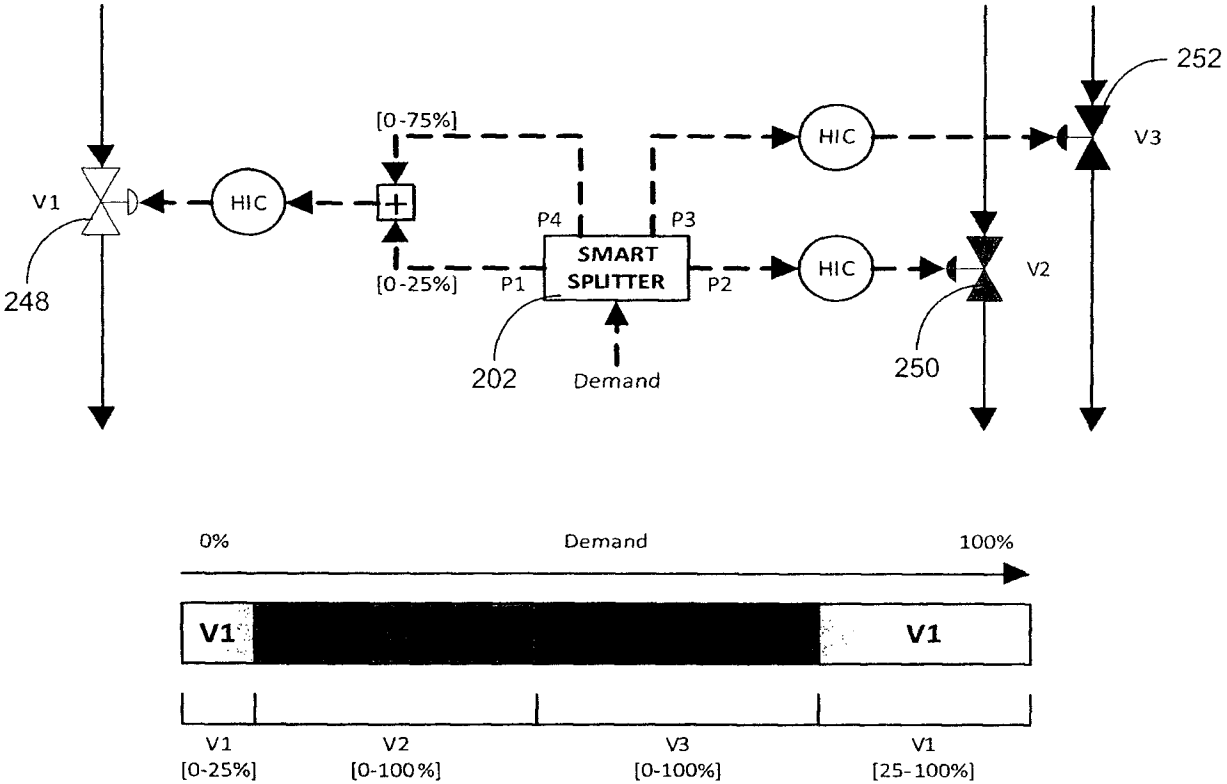
FIG. 4 is a schematic diagram of a multiple steam flow demand dispatch for a single control element using a smart splitter in accordance with an illustrative embodiment of the present invention.

The priority levels may be externally set into the smart splitter 202 and vary depending on external factors, such as the cost of burning fuel or the selling price of electricity. As illustrated in FIG. 4, in some cases, it may indeed be desirable to attribute different priorities to different ranges of operation of a single control element, such as any one of the valves 248, 250, and 252. For example, it may be optimal to favor the opening of the higher priority valve 248 up to 25% of the range of operation thereof, rather than up to full range of operation. It may indeed be desirable to avoid opening the valve 248 beyond 25% and to allow an opening range between 0 and 100% for the lower priority valves, namely valves 250 and 252 before completing the opening of the valve 248 from 25 to 100%. In this manner, the steam flow demand received at the smart splitter 202 will illustratively be directed to valve 248, which is at that point opened up to 25%, while the remaining portion of the steam flow is directed to the lower priority valves 250 and 252, which are opened up to 100%. Depending on the set range of operation of the lower priority valves 250 and 252, if, after passing steam through valves 248, 250, and 252, the total steam flow demand is still not satisfied, the valve 248 may then be opened beyond 25% to allow the remainder of the steam flow to pass therethrough. Such an allocation of steam flow based on operation ranges may be adjusted by dynamically altering the priority factors, biases, and ratios discussed below.

The update in priorities may be done automatically and be triggered by an economical optimization function based on the plant's economic indicators. For instance, depending on the selling price of electricity, the priority of process components responsible for electricity production may change. Indeed, although a pressure reducing valve as in 142 and its associated de-superheating valve (not shown) associated therewith may be used to distribute steam at a desired pressure, using a steam turbine, as in 110 or 112, enables similar distribution with the additional benefit of generating electricity in the process. As a result, if the selling price of electricity reaches a certain level, it may therefore be more desirable to prioritize steam flow through a steam turbine, as in 110 or 112, rather than through a pressure reducing valve as in 142 as additional revenue may be generated in the steam distribution process. Alternatively, if electricity generation turns out to be non-profitable and steam is generated by burning precious fuel, flow through a pressure reducing valve as in 142 may be prioritized as this decreases the load on the boiler. The added water injection effected by the de-superheating valve to reduce the steam superheating would result in an increased steam flow for the process, while the same steam flow in a turbine would result in a smaller output flow for the process since the steam will already be cooled in the turbine by converting the steam energy to mechanical torque.

Taking the feedback components 246*a*, 246*b*, 246*c* and 246*d* into account, the demand dispatch or command signal $S_{out,i}$ sent by the smart splitter 202 to a given control element number i (e.g. control elements 242*a*, 242*b*, 242*c* or 242*d*) may be computed by the smart splitter 202 using equation (1) below:

$$S_{out,i} = \left(\alpha_i + D - \left(\sum_{k=1}^{nb_{comp}} \sum_{j \neq i}^{nb_{ele}} f_{ijk} S_{in,jk}\right) R_j\right) \Big/ R_i + \beta_i \tag{1}$$

where $S_{in,\ jk}$ is the feedback component relating to the flow of element j for a different compensation k, with the main feedback being k=1 and compensations being k>1. D is the total steam flow demand received at the smart splitter 202 from the controller 240, $f_{ijk}$ is a priority factor matrix with additional compensations for each element i, for the other interacting elements j, and for different compensation k. $R_j$ represents the control element ratio, i.e. the ratio of the maximum steam output of element j to the total steam flow of all elements, $u_i$ represents a demand bias parameter that may be adjusted to trigger temporary shifts in the priority level of control element i or to artificially alter the steam flow demand D by adding a bias, and $\beta_i$ represents signal biases that may be adjusted automatically or manually and which apply to the final command signal $S_{out,i}$. It should be understood that additional factors may impact the command signal $S_{out,i}$, which is output by the smart splitter 202 to the control elements as in 242*a*, 242*b*, and 242*c*. Also, any sub-calculation may be artificially limited to either a selected range or an adjustable range, or both, thus mitigating signal excess and incorporating signal limitations due to external factors. For example, high or low limits may be imposed on the command signal $S_{out,i}$ in order to meet process constraints or respond to an optimization function.

For a four-lines smart splitter, such as the smart splitter 202 illustrated in FIG. 3, the command signals sent out to control elements numbers 1, 2, 3 and 4, i.e. control elements 242*a*, 242*b*, 242*c* and 242*d* are therefore obtained from equations (2), (3), (4) and (5) below:

$$S_{out,1} = \left(\begin{array}{c}\alpha_1 + D - (f_{121}S_{in,21} + f_{122}S_{in,22})R_2 - \\ (f_{131}S_{in,31} + f_{132}S_{in,32})R_3 - \\ (f_{141}S_{in,41} + f_{142}S_{in,42})R_4\end{array}\right) \Big/ R_1 + \beta_1 \tag{2}$$

$$S_{out,2} = \left(\begin{array}{c}\alpha_2 + D - (f_{211}S_{in,11} + f_{212}S_{in,12})R_1 - \\ (f_{231}S_{in,31} + f_{232}S_{in,32})R_3 - \\ (f_{241}S_{in,41} + f_{242}S_{in,42})R_4\end{array}\right) \Big/ R_2 + \beta_2 \tag{3}$$

$$S_{out,3} = \left(\begin{array}{c}\alpha_3 + D - (f_{311}S_{in,11} + f_{312}S_{in,12})R_1 - \\ (f_{321}S_{in,21} + f_{322}S_{in,22})R_2 - \\ (f_{341}S_{in,41} + f_{342}S_{in,42})R_4\end{array}\right) \Big/ R_3 + \beta_3 \tag{4}$$

$$S_{out,4} = \left(\begin{array}{c}\alpha_4 + D - (f_{311}S_{in,11} + f_{312}S_{in,12})R_1 - \\ (f_{321}S_{in,21} + f_{322}S_{in,22})R_2 - \\ (f_{431}S_{in,41} + f_{432}S_{in,42})R_3\end{array}\right) \Big/ R_4 + \beta_4 \tag{5}$$

In this manner, the internal logic for a smart splitter as in 202 having four output lines 241*a*, 241*b*, 241*c* and 241*d* may for example be such that the all the flow input demand is first directed to the first output line 241*a* of the smart splitter 202. The flow directed to the second output line 241*b* of the smart splitter 202 may then be equivalent to the total flow input demand minus the feedback representative of the flow directed to the first output line 241*a*. Finally, the flow directed to the third output line 241*c* of the smart splitter 202 may be equivalent to the total flow input demand minus the feedback representative of the flow directed to the first output line 241*a* and to the second output line 241*b*. If for any reason, such as a disruption in the system 200, the flow from output line 241*a* is reduced, the logic applied by the smart splitter 202 will be such that the flow from output lines 241*b* and 241*c* is increased to satisfy the total flow demand.

The priority factor matrix $f_{ijk}$ may be modified by the logic of the smart splitter 202 to compensate for lower priority control elements that may be in a non cascade mode. The feedback of such elements may then be used to compensate the outputs of the higher priority elements. The additional compensation feedbacks may be used to allow additional compensation to the smart splitter outputs.

This is illustrated in FIG. 5*a*, FIG. 5*b*, FIG. 5*c*, FIG. 5*e*, FIG. 5*f*, and FIG. 5*g*, which show examples of how the smart splitter 402 may apportion the steam flow demand to a plurality of output lines 241*a*, 241*b*, 241*c*, 241*d*, and 241*e*, and accordingly to a plurality of control elements, as in 242*a*, coupled thereto. In the illustrated examples, the smart splitter 402 wishes to dispatch the steam flow demand to five output lines with a decreasing priority 241*a*, 241*b*, 241*c*, 241*d*, and 241*e* respectively having available flow of 500 kPPh, 300 kPPh, 300 kPPh, 500 kPPh, and 400 kPPh for a total available flow of 2000 kPPh. Accordingly, the control element ratio $R_j$ of each output line 241*a*, 241*b*, 241*c*, 241*d*, and 241*e* is 25%, 15%, 15%, 25%, and 20%.

As illustrated in FIG. 5*c*, for a total steam flow demand of 25% or 500 kPPh, the logic applied by the smart splitter 402 is such that the first output line 241*a* illustratively receives 100% of the total flow demand, which translates into 500 kPPh being dispatched by the smart splitter 402 to the output line 241*a*. Since the total steam flow demand has been met, no other output line 241*a*, 241*b*, 241*c*, 241*d*, or 241*e* receives a command from the smart splitter 402 to have steam flow passing therethrough.

Figure 5A:
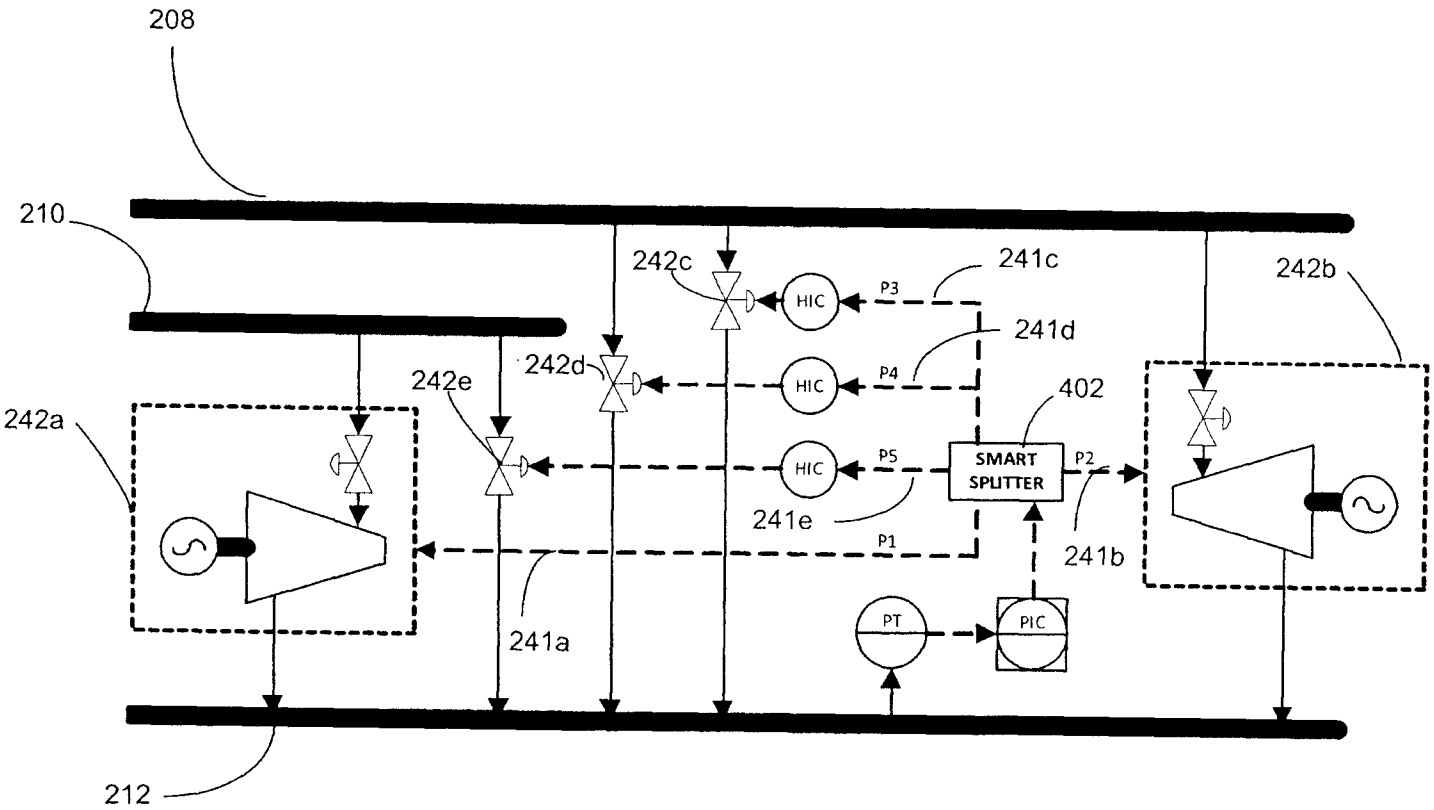
FIG. 5*a* is a schematic of a steam distribution network using a five-lines smart splitter in accordance with an illustrative embodiment of the present invention.
Figure 5D:
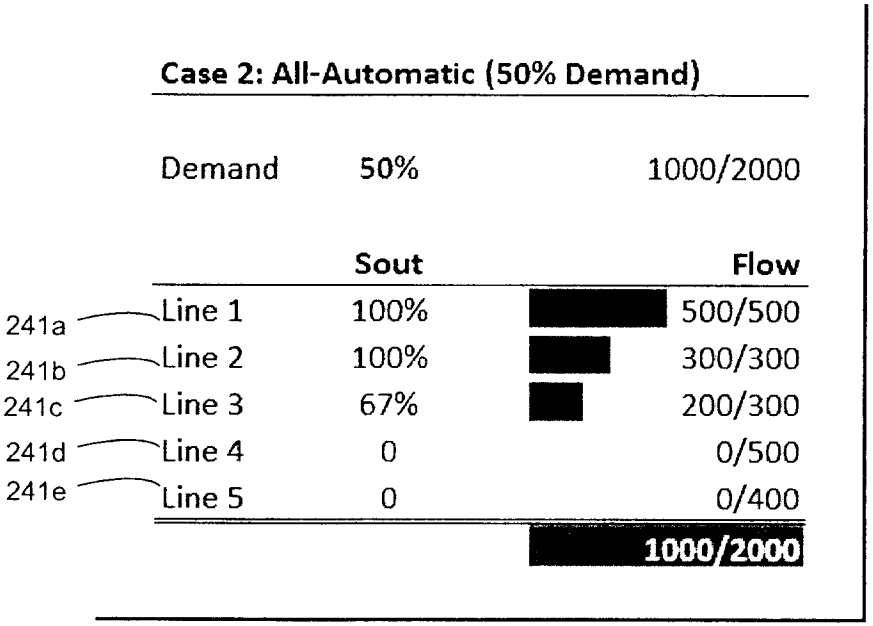
FIG. 5*d* is a table of an apportionment of a 50% steam flow demand when output lines are in automatic mode in accordance with an illustrative embodiment of the present invention.

As illustrated in FIG. 5*d*, for a higher total steam flow demand of 50% or 1000 kPPh, the smart splitter 402 not only dispatches the flow demand to the first output line 241*a* but to lower priority lines as well, such as output lines 241*b* and 241*c*, since the first output line 241*a* is not able to carry the whole of the demand.

Figure 5E:
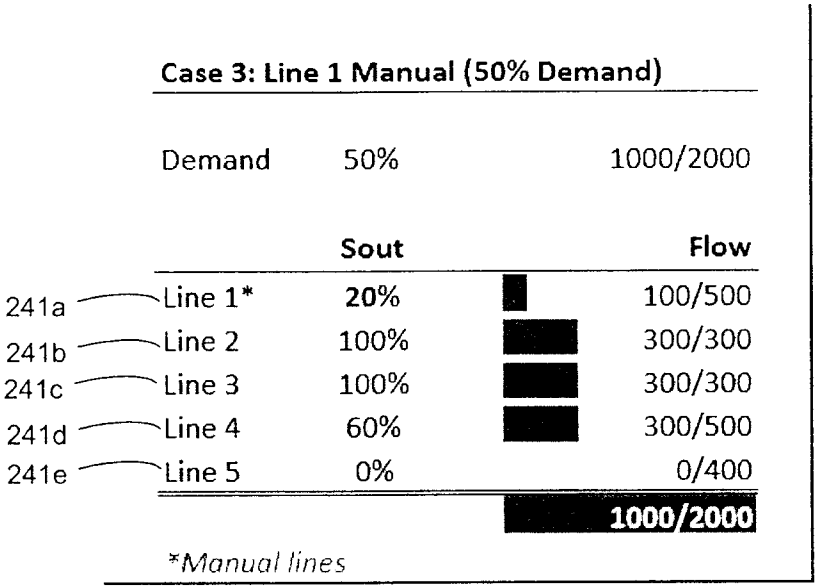
FIG. 5*e* is a table of an apportionment of a 50% steam flow demand when a first priority output line is in manual mode in accordance with an illustrative embodiment of the present invention.
Figure 5F:
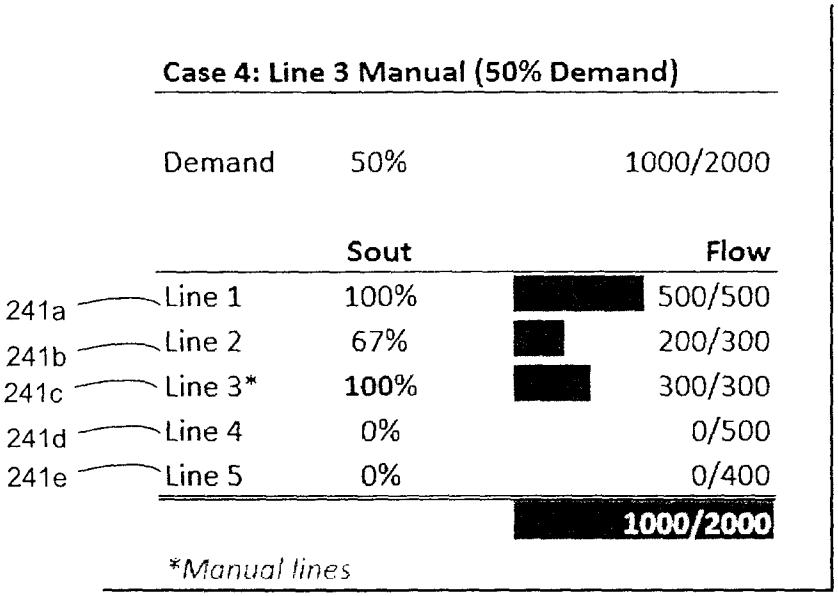
FIG. 5*f* is a table of an apportionment of a 50% steam flow demand when a third priority output line is in manual mode in accordance with an illustrative embodiment of the present invention.
Figure 5G:
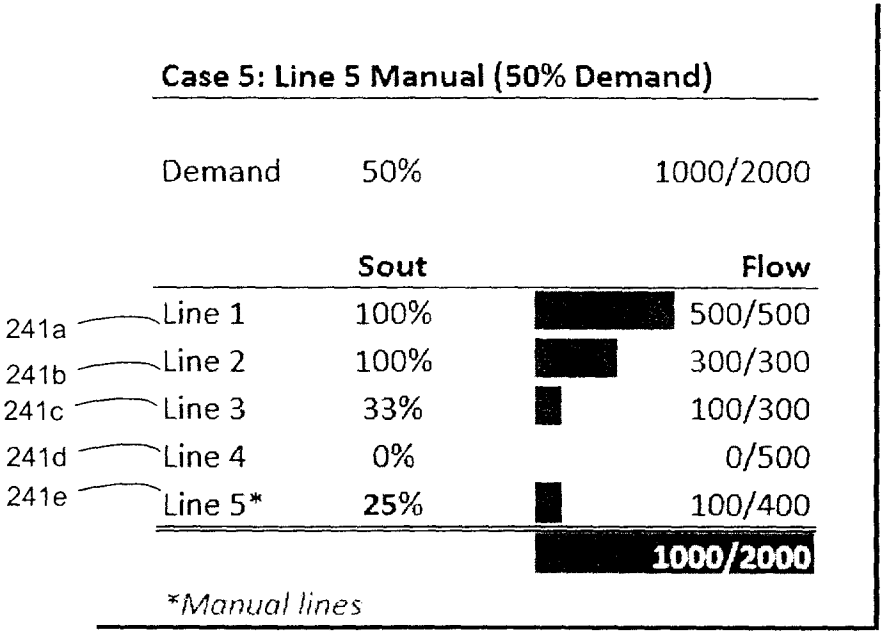
FIG. 5*g* is a table of an apportionment of a 50% steam flow demand when a fifth priority output line is in manual mode in accordance with an illustrative embodiment of the present invention.

As illustrated in FIG. 5*e*, FIG. 5*f*, and FIG. 5*g*, at least one of the output lines 241*a*, 241*b*, 241*c*, 241*d*, and 241*e* may enter into a manual mode. For example, output line 241*a* may be entered into a manual mode using the hand controller (not shown) coupled thereto and be limited to 20% steam flow (FIG. 5*e*). In order to satisfy the input flow demand, the remaining outputs of the smart splitter 402 may thus be modified accordingly taking into account the flow value set manually for the output line whose hand controller is in manual mode. As a result, for a total steam flow demand of 50% or 1000 kPPh, the smart splitter 402 may only dispatch 20% or 100 kPPh steam flow through output line 241*a*. The remaining 900 kPPh is then apportioned among the lower priority output lines 241*b*, 241*c*, and 241*d*. When the hand controller is switched out of manual mode and back into a cascade mode, the target flow value thereof may be set so as to re-establish the pre-determined priority order.

If lower priority output lines as in 241*b*, 241*c*, 241*d*, and 241*e* also enter into a manual mode, this may impact the dispatching logic applied by the smart splitter 402, the latter adjusting the higher priority lines as in 241*a* accordingly. For example, for a total steam flow demand of 50% or 1000 kPPh, if output line 241*c* enters a manual mode and is limited to 100% or 300 kPPh out of the 300 kPPh the line 241*c* is able to carry (FIG. 5*f*), the smart splitter 402 may direct 300 kPPH to flow through output line 241*c* while the remaining 700 kPPh may be apportioned between output line 241*a*, which still receives 100% or 500 kPPh of steam flow, and output line 241*b*, which receives the remaining 200 kPPH, i.e. 67% of the total capacity of 300 kPPh of line 241*c*. The remaining output lines 241*d* and 241*e* do not need to receive any steam flow as the demand has been satisfied by the higher priority output lines 241*a*, 241*b*, and 241*c*.

If output line 241*e* enters a manual mode and is limited to 25% or 100 kPPh out of the 400 kPPh the line 241*e* is able to carry (FIG. 5*g*), the smart splitter 402 may direct 100 kPPh to flow through output line 241*e* while the remaining 900 kPPh is apportioned between output line 241*a*, which still receives 100% or 500 kPPh of steam flow, output line 241*b*, which receives 100% or 300 kPPh of steam flow, and output line 241*b*, which receives the remaining 100 kPPh, i.e. 33% of the total capacity of 300 kPPh of line 241*b*. Although output line 241*d* has a higher priority than output line 241*e*, the former does not receive any steam flow from the smart splitter 402 as the output line 241*e* has been moved to a manual mode and, as such, the smart splitter 402 has no control over this control element and needs to compensate on the remaining control elements.

Figure 6A:
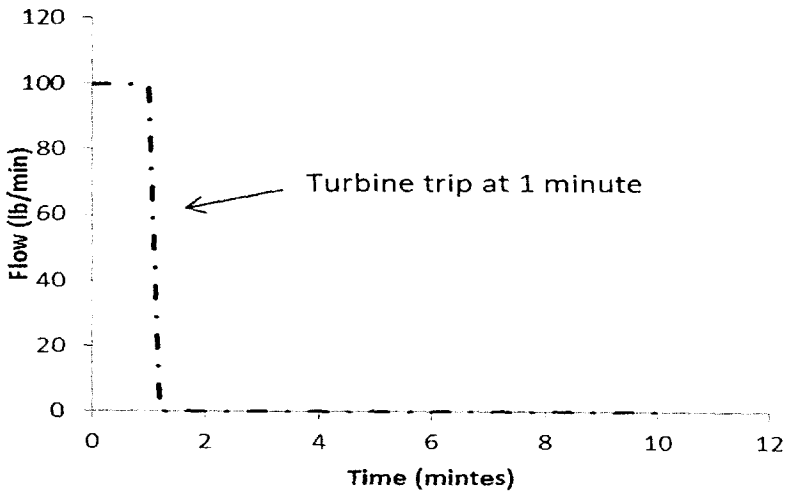
FIG. 6*a* is a graph of a flow of steam through a tripped turbine in accordance with an illustrative embodiment of the present invention.
Figure 6B:
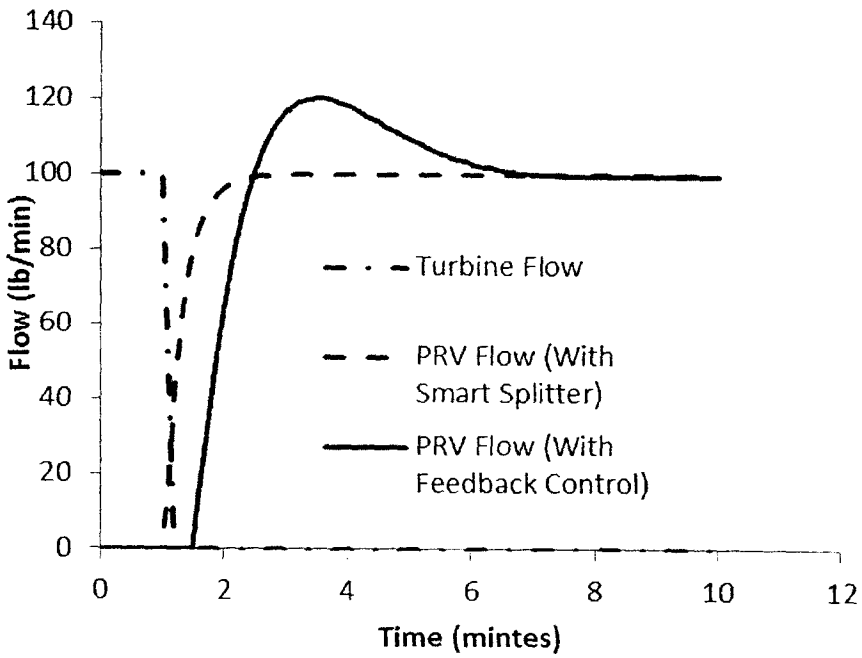
FIG. 6*b* is a graph of a flow of steam through control elements during a turbine trip in accordance with an illustrative embodiment of the present invention.
Figure 6C:
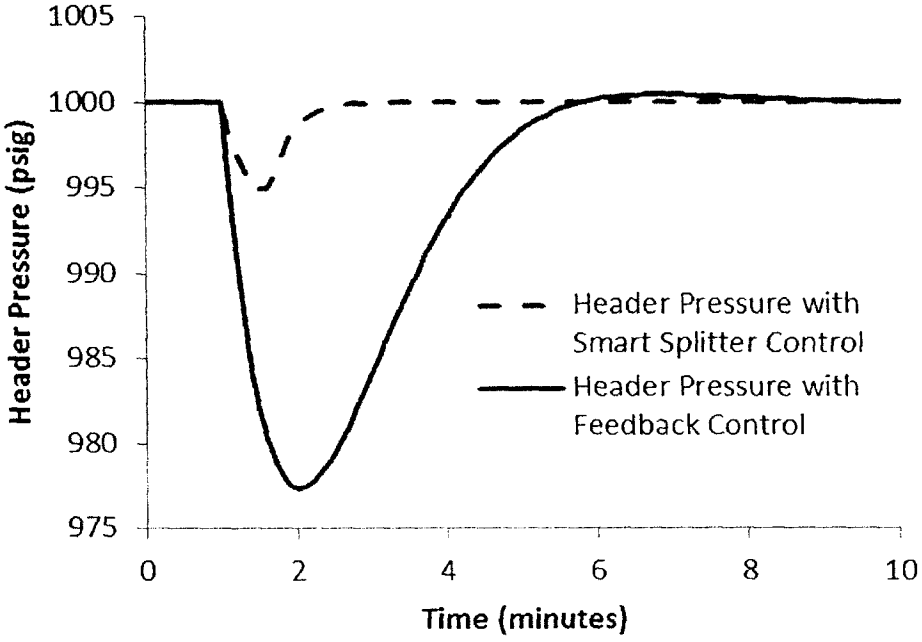
FIG. 6*c* is a graph of a pressure level through a steam header during a turbine trip in accordance with an illustrative embodiment of the present invention.

Referring to FIG. 6*a*, FIG. 6*b*, and FIG. 6*c* in addition to FIG. 3, using the feedback control loop described above, process variations and perturbations, such as equipment tripping, i.e. equipment undergoing a sudden shut-down due to a disruption on the network 200, and physical limitations of the control elements 242*a*, 242*b*, and 242*c*, may be taken into account. In this manner, robustness in controlling the steam pressure, flexibility in operating the system 200, as well as optimization of operating conditions with respect to technical and economical constraints may be achieved.

In particular, the use of a smart splitter 202 proves advantageous in cases of a trip of a turbine as in 206. In the illustrated example, steam is transferred from a high pressure header, as in 208, to a low pressure header, as in 212 with a flow of 100 lb/min. After about one minute, a turbine trip occurs and no more flow enters into the low pressure header 208 (FIG. 6*a*). A pressure reducing valve, as in 228, provided between the headers 208 and 212 may be manipulated by a traditional controller (not shown), in order to reroute the flow of steam and thus avoid the turbine 206. Because it is limited by the controller's dynamic, a traditional feedback control would be likely to slowly react due to iterations needed to produce an output to correct the error in pressure, whereas the smart splitter 202 may react instantly to reallocate the flow demand. Indeed, in case of a trip of the turbine 206, the smart splitter 202 recalculates the optimal steady state operating point based on flow availability, as described above. From a feedback signal received from the tripped turbine 206, the smart splitter 202 may detect that no flow is available and thus turn to a lower priority element, in this case the pressure reducing valve 228, to direct the steam flow demand. As a result, using the smart splitter 202, the flow through the control element controlled by the smart splitter 202 (FIG. 6*b*) and the pressure in the low pressure steam header 212 (FIG. 6*c*) may be recovered almost instantly whereas when traditional feedback control is used recovery is delayed. The response to a perturbation of the system 200 therefore occurs faster than with traditional control.

Figure 7:
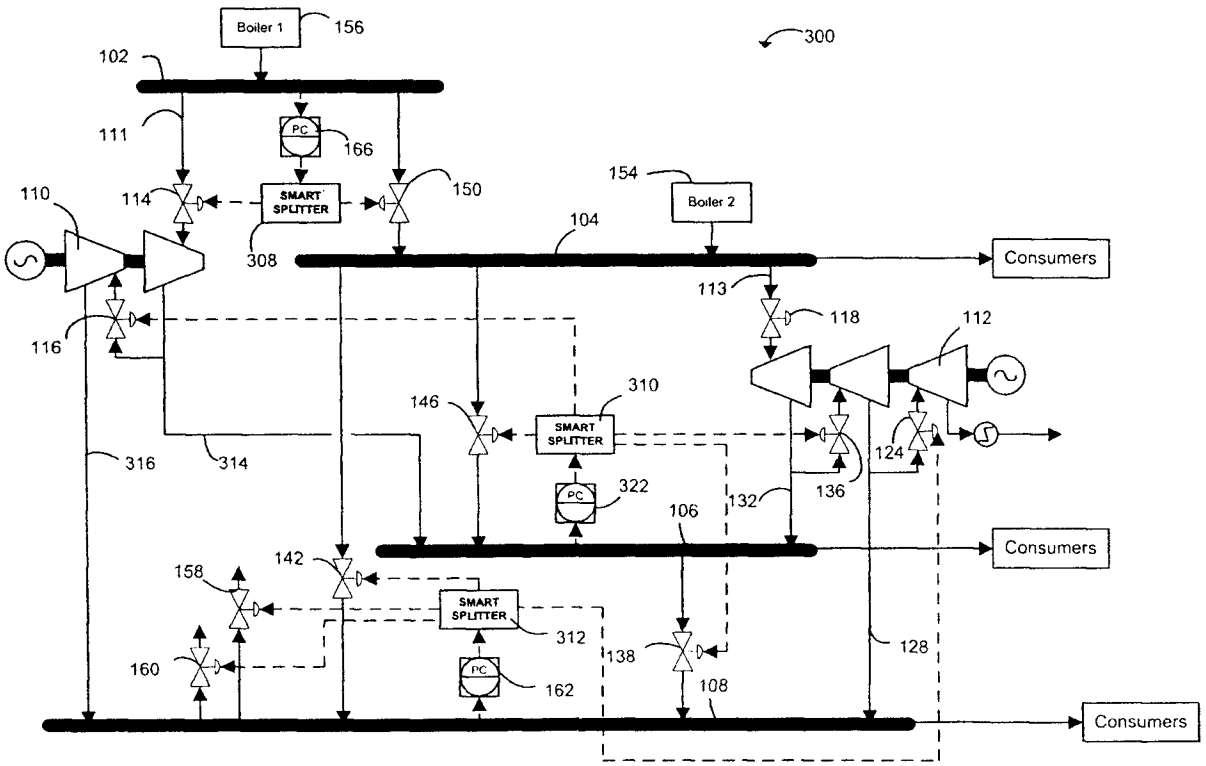
FIG. 7 is a schematic diagram of a steam distribution network using smart splitters in accordance with an illustrative embodiment of the present invention.

Referring to FIG. 7, a steam distribution network 300 using a plurality of smart splitters: 308, 310 and 312 will now be described. The network 300 illustratively comprises the very high pressure steam header 102, high pressure steam header 104, medium pressure steam header 106, and low pressure steam header 108, supplied by boiler 156 and boiler 154. The steam turbine 110 extracts steam from the steam header 102 through a steam line 111 connected to inlet control valve 304. The extraction 314 of the steam turbine 110 supplies the medium pressure steam header 106 and the exhaust 316 of the steam turbine 110 further supplies the low pressure steam header 108. The steam turbine 112 illustratively operates in parallel with the steam turbine 110 and extracts steam from the high pressure steam header 104 through a steam line 113 connected to control valve 118. The first extraction 132 of the steam turbine 112 supplies the medium pressure header 106 while the second extraction 128 of the steam turbine 112 supplies, the low pressure steam header 108.

Steam is fed by the boiler 156 to the very high pressure steam header 102 and flow out through at least one of the turbine 110 and the pressure reducing valve 150. The pressure level in the very high pressure steam header 102 may therefore be controlled by either the flow through the turbine 110 or the pressure reducing valve 150.

Pressure controller 166 is illustratively the very high pressure controller whose output is a flow demand to the very high pressure smart splitter 308 and represents the steam flow production of the boiler 156, which is dispatched by the smart splitter 308 to either the steam turbine 110 or the pressure reducing valve 150 feeding the high pressure steam header 104 from the very high pressure steam header 102. For this purpose, the smart splitter 308 determines the appropriate apportionment of the steam flow from the very high pressure steam header 102 and accordingly the optimum position of the valves 114 and 150 respectively feeding the turbine 110 and the high pressure steam header 104 accordingly with the order of priority set in the smart splitter 308. The smart splitter 308 illustratively attempts to maximize the load of steam flow to the turbine 110 and, as such, the smart splitter 368 has two outputs of different priority, the output having first priority being the valve 304 controlling flow through the turbine 110, and the output having second priority being the pressure reducing valve 150. This priority configuration favors the electricity production, however depending on fuel price and electricity price, the priority order may be changed online to minimize fuel consumption.

The smart splitter 308, in recognizing a lack of response from a control element, such as the valve 304 or 150, illustratively dispatches the remaining demand to other lines. For example, in the event of a trip of the turbine 110, the smart splitter 308 may instantaneously transfer the steam flow from the turbine 110 to high pressure header 104 through the pressure reducing valve 150. When the maximum steam flow through the turbine 110 has been reached, the smart splitter 308 may then open the pressure valve 150 to enable steam to flow from the very high pressure steam header 102 to the high pressure steam header 104. During startup of the turbine 110, the smart splitter 308 may also estimate the appropriate steam flow to the turbine 110 and automatically close the valve 150 accordingly.

The medium pressure steam header 106 is illustratively fed from the high pressure header 104 via the pressure reducing valve 146, from the extraction 314 of the turbine 110, and from the extraction 132 of the turbine 112. The medium pressure steam header 106 may also release steam to the low pressure steam header 108 by the pressure reducing valve 138. The pressure controller 322 may control the pressure level of the medium pressure steam header 106 through the smart splitter 310. For this purpose, the output of the pressure controller 322 represents the flow demand to the smart splitter 310. The smart splitter 310 in turn illustratively has four outputs of different priority, the output having the first priority being the pressure reduction valve 138 (negative flow, the valve will close with increasing output), the output having the second priority being the remote extraction set point of turbine 110, the output having the third priority being the remote extraction set point of turbine 112 and the output having the fourth priority being the pressure reducing valve 146. This priority configuration favors electricity production, however depending on fuel price and electricity price, the priority order may be changed online to minimize fuel consumption.

In the event of a trip of turbine 110, the corresponding feedback signal received at the smart splitter 310 may be forced to zero and the smart splitter 310 may automatically increase the first extraction demand to the turbine 112 and, if required, open the pressure reducing valve 146 to counter the loss in extraction flow.

The low pressure steam header 108 may be fed from the high pressure steam header 104 via the pressure reducing valve 142, from the exhaust 316 of the turbine 110, from the extraction 128 of the turbine 112. The low pressure steam header 108 may also release steam to the atmosphere by the vent valves 158 and 160. The pressure in the low pressure steam header 108 may be controlled by a pressure controller 162. The pressure controller 162 may control the pressure in the low pressure steam header 108 through the smart splitter 312. The output of the pressure controller 162 is illustratively the flow demand to the smart splitter 312, which has four outputs of different priority, the output having first priority being the first vent valve 158, the output having second priority being the second vent valve 160, the third priority being the second extraction demand of turbine 112 and the output having fourth priority being the pressure reducing valve 142. In its computation to apportion the steam flow demand, the smart splitter 312 may further take into consideration the flow coming from the exhaust 316 of the turbine 110 even though such a flow is uncontrolled.

In the event of a trip of turbine 110, the feedback value for the exhaust 316 of turbine 110, which is sent to the smart splitter 312, may automatically be forced to zero causing an immediate increase in demand on the extraction 128 and on the pressure reducing valve 142 in order to satisfy the flow demand before the header pressure decreases.

In the event that the uncontrolled exhaust steam flow from turbine 110 exceeds the steam consumed by the low pressure header consumers, causing the pressure to increase, the smart-splitter 312 may automatically open the second vent valve 160 followed by the first vent valve 158 after completely closing the pressure reducing valve 142 and the turbine 112 second extraction 128, releasing steam to the atmosphere. If the electricity price is high, this may be economically profitable in order to maximize electricity production on turbine 110.

Using the system 300, each smart splitter 308, 310, or 312 advantageously prioritizes steam flow feeds according to their source as well as to the state of the system's control elements. Economically viable on-line process decision can therefore be achieved. As a result, shifts in the priority levels of control elements or perturbations in the availability thereof may be alleviated dynamically.

While illustrated in the block diagrams as groups of discrete components communicating with each other via distinct data signal connections, it will be understood by those skilled in the art that the present embodiments are provided by a combination of hardware and software components, with some components being implemented by a given function or operation of a hardware or software system, and many of the data paths illustrated being implemented by data communication within a computer application or operating system. The structure illustrated is thus provided for efficiency of teaching the present embodiment.

It should be noted that the present invention can be carried out as a method, can be embodied in a system, a computer readable medium or an electrical or electro-magnetic signal. The embodiments of the invention described above are intended to be exemplary only. The scope of the invention is therefore intended to be limited solely by the scope of the appended claims.

The invention claimed is:

1. A control system for allocating a flow of steam from or to a steam header having a first pressure level to or from a plurality of pressure adjusting devices, the system comprising a pressure unit adapted to measure the first pressure level in the steam header, determine a difference between the first pressure level as measured and a desired pressure level, and generate a demand signal representative of a steam flow demand needed to adjust the pressure level in the steam header to correspond to the desired pressure level;

at least one status monitoring unit coupled to the plurality of pressure adjusting devices for monitoring an output flow thereof; and a dispatching device having at least one input coupled to the pressure unit and to the at least one status monitoring unit, and at least one output coupled to the plurality of pressure adjusting devices, the dispatching device adapted to:

receive the demand signal from the pressure unit;

allocate the flow of steam among the plurality of pressure adjusting devices from the steam header as a function of the demand signal and in accordance with a priority scheme;

receive from the status monitoring unit at least one feedback signal representative of a response of the plurality of pressure adjusting devices to allocation of the flow of steam; and adjust allocation of the flow of steam on the basis of the at least one feedback signal.

2. The system of claim 1, wherein the pressure unit is adapted to generate the demand signal as a difference between a preceding demand and a current demand.

3. The system of claim 1, wherein the at least one status monitoring unit comprises a status monitoring unit for each of the plurality of pressure adjusting devices.

4. The system of claim 1, wherein the dispatching device is adapted to compare the output flow of each one of the plurality of pressure adjusting devices to the flow of steam allocated to each one of the plurality of pressure adjusting devices to assess the response of each one of the plurality of pressure adjusting devices.

5. The system of claim 1, wherein the dispatching device comprises at least one first input coupled to the pressure unit and at least one second input coupled to the at least one status monitoring unit.

6. The system of claim 1, wherein the dispatching device comprises at least one output coupled to each one of the plurality of pressure adjusting devices.

7. The system of claim 1, wherein the dispatching device is adapted to allocate the flow of steam amongst at least one of a pressure control valve, a steam turbine, a condenser, a boiler, and a compressor.

8. The system of claim 1, wherein the dispatching device is adapted to allocate the flow of steam among the plurality of pressure adjusting devices using the priority scheme while taking into account a manual setting of the flow of steam through at least one of the plurality of pressure adjusting devices.

9. The system of claim 8, wherein the manual setting corresponds to a fixed amount of steam set to flow through the at least one of the plurality of pressure adjusting devices.

10. The system of claim 1, wherein the dispatching device is adapted to allocate the flow of steam in accordance with the priority scheme by taking into account a steam flow capacity of at least one of the pressure adjusting devices.

11. The system of claim 1, wherein the dispatching device is adapted to allocate the flow of steam in accordance with the priority scheme by taking into account at least one economic factor.

12. The system of claim 11, wherein the at least one economic factor comprises at least one of a selling price of electricity and a cost of burning fuel.

13. The system of claim 1, wherein the dispatching device allocates the flow of steam by considering pre-assigned priorities, steam flow capacity, manual settings, economic factors, and malfunctioning equipment, and adjusts allocation as a function of responsiveness of the pressure adjusting devices.

14. A method for allocating a flow of steam from or to a steam header having a first pressure level to or from a plurality of pressure adjusting devices, the method comprising:

measuring the first pressure level in the steam header;

determining a difference between the first pressure level as measured and a desired pressure level;

generating a demand signal representative of a steam flow demand needed to adjust the pressure level in the steam header to correspond to the desired pressure level;

allocating the flow of steam among the plurality of pressure adjusting devices from the steam header as a function of the demand signal and in accordance with a priority scheme;

monitoring a response of the plurality of pressure adjusting devices to allocation of the flow of steam; and adjusting the allocation of the flow of steam on the basis of the response as monitored.

15. The method of claim 14, wherein the demand signal is generated as a difference between a preceding demand and a current demand.

16. The method of claim 14, wherein monitoring comprises monitoring each of the plurality of pressure adjusting devices independently.

17. The method of claim 14, wherein monitoring comprises measuring the output flow downstream from at least one of the plurality of pressure adjusting devices.

18. The method of claim 14, wherein monitoring an output flow comprises comparing the output flow of each one of the plurality of pressure adjusting devices to the flow of steam allocated to each one of the plurality of pressure adjusting devices to assess the response of each one of the plurality of pressure adjusting devices.

19. The method of claim 14, wherein allocating the flow of steam comprises allocating amongst at least one of a pressure valve and a steam turbine.

20. The method of claim 14, wherein allocating the flow of steam comprises allocating among the plurality of pressure adjusting devices using the priority scheme while taking into account a manual setting of the flow of steam through at least one of the plurality of pressure adjusting devices.

21. The method of claim 20, wherein the manual setting corresponds to a fixed amount of steam set to flow through the at least one of the plurality of pressure adjusting devices.

22. The method of claim 14, wherein allocating comprises allocating the flow of steam in accordance with the priority scheme by taking into account a steam flow capacity of at least one of the pressure adjusting devices.

23. The method of claim 14, wherein allocating comprises allocating the flow of steam in accordance with the priority scheme by taking into account at least one economic factor.

24. The method of claim 23, wherein the at least one economic factor comprises at least one of a selling price of electricity and a cost of burning fuel.

25. The method of claim 14, wherein allocating comprises allocates the flow of steam by considering pre-assigned priorities, steam flow capacity, manual settings, economic factors, and malfunctioning equipment, and adjusts allocation as a function of responsiveness of the pressure adjusting devices.

* * * * *